US007494445B1

(12) United States Patent
Chen

(10) Patent No.: US 7,494,445 B1
(45) Date of Patent: Feb. 24, 2009

(54) ADJUSTABLE TRAMPOLINE PAD SYSTEM

(76) Inventor: Samuel Chen, Flat M, 3 Floor, Kaiser Estate Phase 3, Hok Yuen St., Kowloon, Hong Kong (CN)

( * ) Notice: Subject to any disclaimer, the term of this patent is extended or adjusted under 35 U.S.C. 154(b) by 0 days.

(21) Appl. No.: 11/982,619

(22) Filed: Nov. 3, 2007

(51) Int. Cl.
*A63B 5/11* (2006.01)

(52) U.S. Cl. ..... 482/27; 482/35

(58) Field of Classification Search ..... 482/27, 482/28; 5/187, 189, 902, 417–420; 462/35
See application file for complete search history.

(56) References Cited

U.S. PATENT DOCUMENTS 4,331,329 A * 5/1982 Mirkovich et al. ..... 482/27
5,088,139 A * 2/1992 Bloom ..... 5/420
6,001,045 A * 12/1999 Gift et al. ..... 482/27
6,193,632 B1 * 2/2001 Steger ..... 482/27

* cited by examiner

*Primary Examiner*—Jerome Donnelly
(74) *Attorney, Agent, or Firm*—Clement Cheng

(57) ABSTRACT

An adjustable trampoline pad system is for a trampoline. The adjustable trampoline pad system has a main trampoline pad section having a plastic foam core enveloped inside an exterior cover. The main trampoline pad section has an arc shape roughly following the circumference of a trampoline frame. A main trampoline pad outside flap connects to the main trampoline pad section at an external periphery of the main trampoline pad section. A first extension pad section removably connects to the main trampoline pad section. The first extension pad section has an arc shape roughly following the curvature of the main trampoline pad section. A first extension pad outside flap connects to the first extension pad section at an external periphery of the first extension pad section. A second extension pad section is removably connected to the main trampoline pad section and the movably connected to the first extension pad section.

10 Claims, 6 Drawing Sheets

ADJUSTABLE TRAMPOLINE PAD SYSTEM

BACKGROUND

Trampolines typically have a rigid frame that is often made of a metal such as steel. The rigid frame typically has a tubular construction and is pieced together on site. A trampoline purchaser purchases a trampoline with a frame, a bed and a number of trampoline springs. The trampoline springs connect to the bed to support the trampoline bed in an outstretched suspended position. The trampoline spring is typically a helical spring having a coil portion between a pair of outstretched hook ends. The trampoline spring is connected between the trampoline bed and the trampoline frame. A trampoline pad also fits over the springs and also covers the trampoline frame at the trampoline frame periphery to protect a user against accidental injury when falling on the trampoline frame.

The trampolines also come in a variety of sizes and diameters so that different users having different sizing needs can have a trampoline that fits well in the backyard. Typically, a single trampoline pad covers the periphery of the trampoline bed. Unfortunately, there is still no single trampoline pad that can be adjusted in size to cover different trampoline sizes and configurations.

Figure 1:
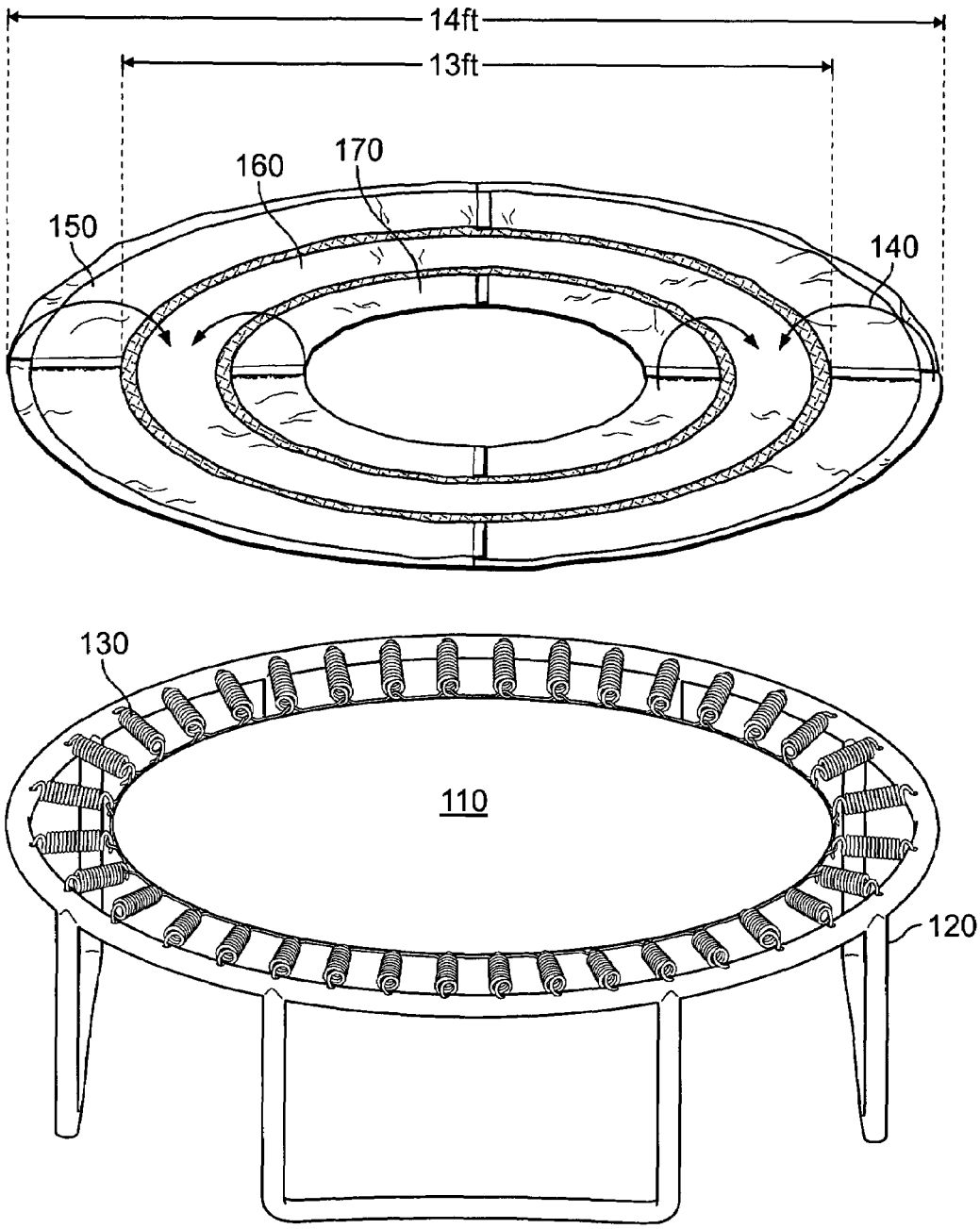
FIG. 1 is a diagram of various flap configurations over a trampoline

The call out list of elements denotes the elements shown in the figures.

34 Squares of hook portions
35 Loop strip portion
38 Straps
39 Main section straps
47 Pocket opening
52 Cushion portion
65 Outside perimeter flap
68 Pair of frame straps
80 Main trampoline pad section
88 Pad sections
110 Trampoline bed
120 Trampoline frame
130 Trampoline springs
140 Trampoline pad
150 Outside flap pad
151 Fabric flap joint
160 Middle portion pad
170 Inside flap pad
171 Riser pad

180 First extension section
280 Second extension section
288 Hook strips

DETAILED DESCRIPTION OF THE PREFERRED EMBODIMENT

Trampoline bed 110 is supported by springs 130 and a frame 120. As seen in FIG. 1, the trampoline pad 140 has an inside flap pad 170, a middle portion pad 160 and an outside flap pad 150. The trampoline is shown in an unfolded configuration in FIG. 1. The inside flap pad 170 and the outside flap 150 fold over or under the middle portion pad 160. When the inside flap pad 170 folds over the middle portion pad 160, the inside radius of the trampoline pad increases so that the trampoline pad 140 can be used on a larger trampoline. When the outside flap pad 150 folds over the middle portion pad 160, the outside radius of the trampoline pad decreases so that the trampoline pad 140 can be used on a smaller trampoline. The outside flap pad 150 folded over the middle portion pad 160 provides a thick portion where the outside flap pad 170 forms a stepped or raised protection portion laying above the middle portion pad 160. The thick portion made by overlapping pad portions is preferably positioned over the periphery of the trampoline frame 120.

Figure 2:
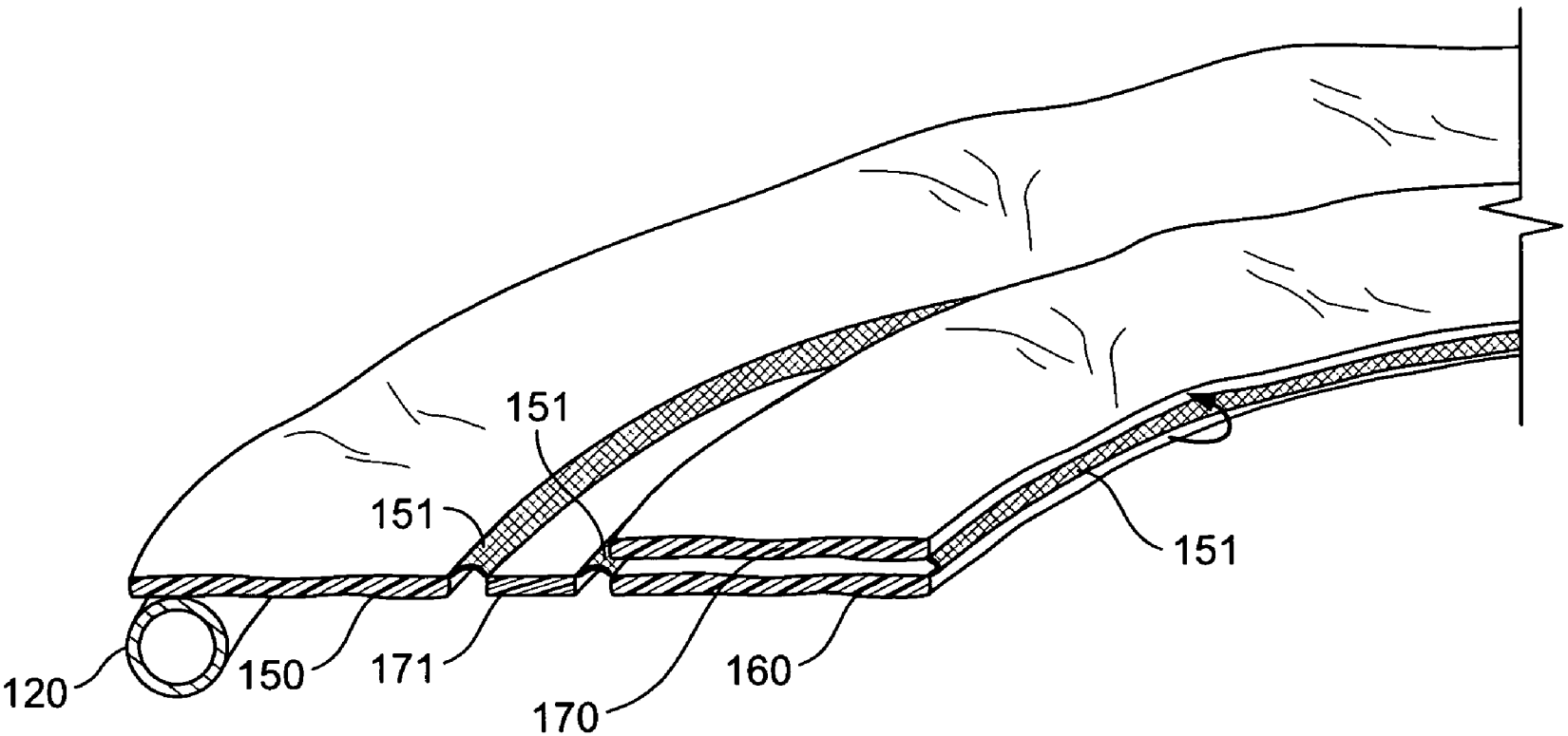
FIG. 2 is a cross-section view of a trampoline pad deployed over a trampoline frame with the inside flap pad folded in FIG. 3 is a cross-section view of a trampoline pad with all flap pads folded in FIG. 4 is a cross section view of a trampoline pad with only the outer flap pad folded in FIG. 5 is a perspective view showing overlapping of trampoline pad sections connected by hook and loop tape

As seen in FIG. 2, the fabric flap joint 151 provides a loose flap connection between the inside flap pad 170 and the middle portion pad 160. The inside flap pad 170 is formed as a plastic foam core portion that has a fabric cover. All pad sections would be similarly constructed having a plastic foam core portion covered by a plastic fabric cover. The fabric cover preferably has a fabric flap joint 151 sewn to connect the middle portion pad 160 to the inside flap pad 170. A similar fabric flap joint 151 connects the outside flap pad 150 to the middle portion pad 160. Preferably, a riser pad 171 provides a connection between the middle portion pad 160 and the outside flap pad 150.

Figure 3:
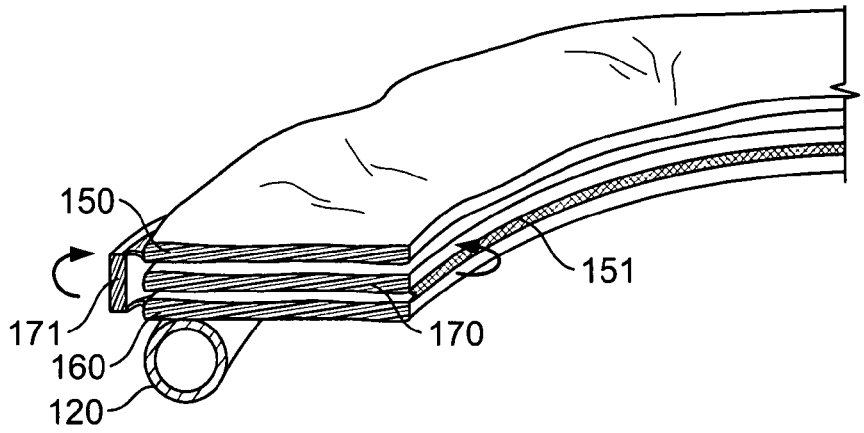
Figure 4:
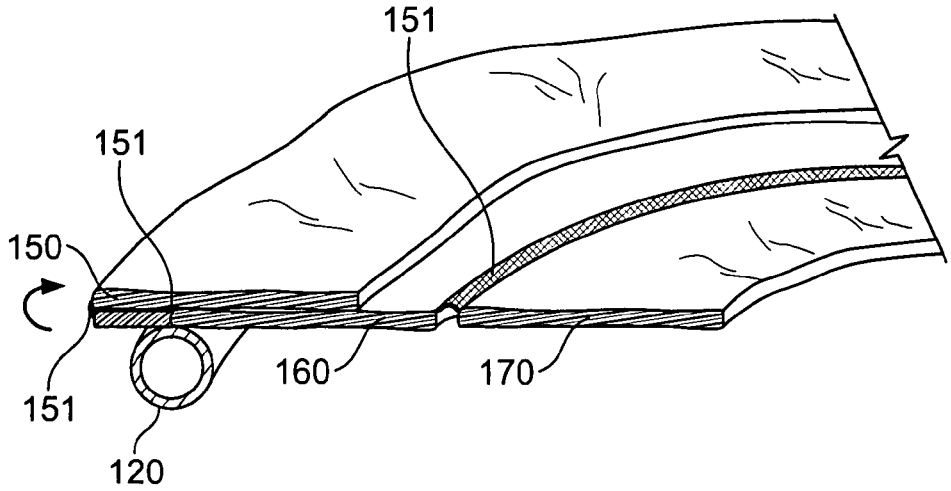

When the inside flap pad 170 is folded over the middle portion pad 160 in a larger diameter folded configuration, the outside flap pad 150 remains flat to cover the springs. A user may also fold the outside flap pad 150 over the inside flap pad 170 if the gap between the spring and the trampoline bed is small such that the outside flap pad 150 would extend over the outer edge of the trampoline. When a smaller gap calls for a smaller pad width, the small width folded configuration as seen in FIG. 3 accommodates the smaller gap. Therefore, the present invention adjustable trampoline pad provides various interior pad diameters as well as adjustable width. The third folded configuration as seen in FIG. 4 provides additional padding for the trampoline frame 120. The third folded configuration is the smaller diameter folded configuration having the outside flap pad 150 folded over the middle portion pad 160. The third folded configuration shows a trampoline frame 120 member as a round tubular cross-section. The trampoline frame 120 is preferably hollow. The trampoline pad sections can be folded to overlie the trampoline frame 120. The inside flap pad 170 remains in extended position, or can be folded over the outside flap pad 150. A middle portion pad 160 remains between the trampoline frame 120 and the other flap pad portions.

Figure 5:
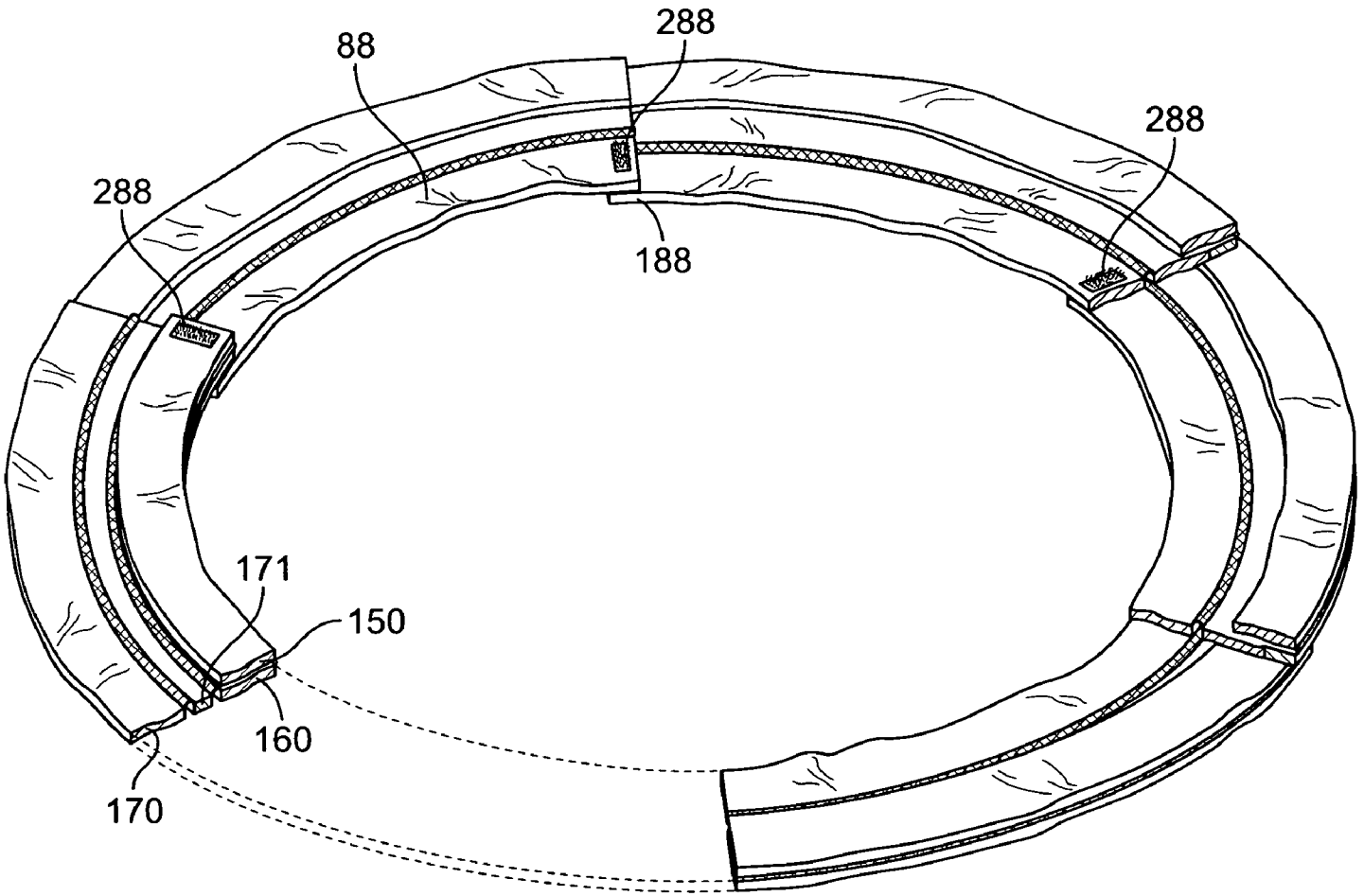

A trampoline pad shown in FIG. 5 has a multiplicity of sections 88 that have hook and loop tape strips interconnecting the pad sections 88. A number of hook strips 288 have protruding hooks that latch onto loop tape strips 188. The trampoline pad therefore has an overlapping configuration where a top portion of a trampoline pad section has a hook or loop tape strip can connect to a bottom portion of a trampoline pad section having an opposing hook or loop tape strip.

Figure 6:
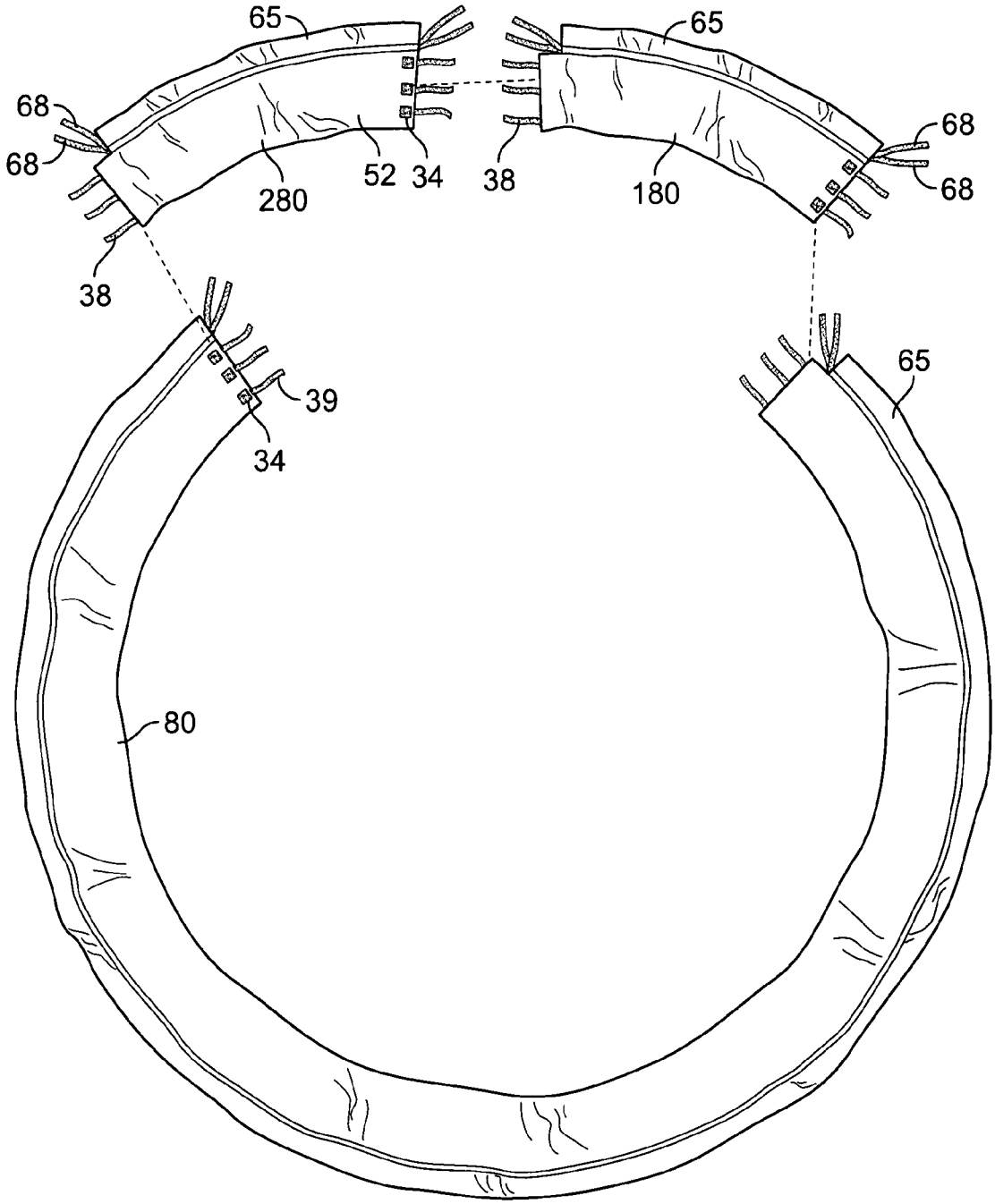
FIG. 6 is a top view of a main section having a pair of extension sections

As shown in FIG. 6, a main pad portion 80 has optional connection with a pair of extension sections. Preferably, the main pad portion 80 has a small diameter configuration where the first end of the main pad portion 80 can connect to a second end of the main pad portion 80. By omitting the first extension section 180 and the second extension section 280, the main pad portion 80 provides a smaller diameter. The smaller diameter configuration is for a smaller diameter trampoline. The strips of hook and loop tape are shown here has square patches 34. Various square patches of hook and loop tape at the periphery ends of the sections provide hook and loop retention between the section members. The second extension section 280 has a cushion section 52. The cushion section 52 cushions the user from a fall.

A medium-size configuration can be implemented by tying the connecting strap ends together between the first extension section 180 and the main section 80. The first extension section 180 has straps 38 that connect to main section straps 39. The first extension section further includes a pair of frame straps 68 and an outside perimeter flap 65. A pair of pair of frame straps 68 at both ends of the first extension section can be connected to the main section 80 and by manual strapping. Also, the second extension section 280 can also have the same pair of pair of rain straps 68. The outside perimeter flap 65 is found on both the first extension section 180 and the second extension section 280. The outside perimeter flap 65 can also be put on the main section 80. The outer perimeter flap 65 can be an empty flap having no plastic foam padding, or the outer perimeter flap 65 can have some plastic foam padding. The outer perimeter flap 65 can also have a full foam padding. With the first extension section 180, the trampoline has a medium-size configuration that has a medium-size diameter and a medium-size circumference.

A large sized configuration can be implemented by tying the connecting straps together between the main section 80, the first extension section 180 and the second extension section 280. This may provide a 14 foot or 13 foot diameter depending upon typical trampoline sizes in the industry. The main trampoline pad section 80 may have an arc shape roughly following the circumference of a trampoline frame 120. The first extension pad section preferably has an arc shape roughly following the curvature of the main trampoline pad section.

Figure 7:
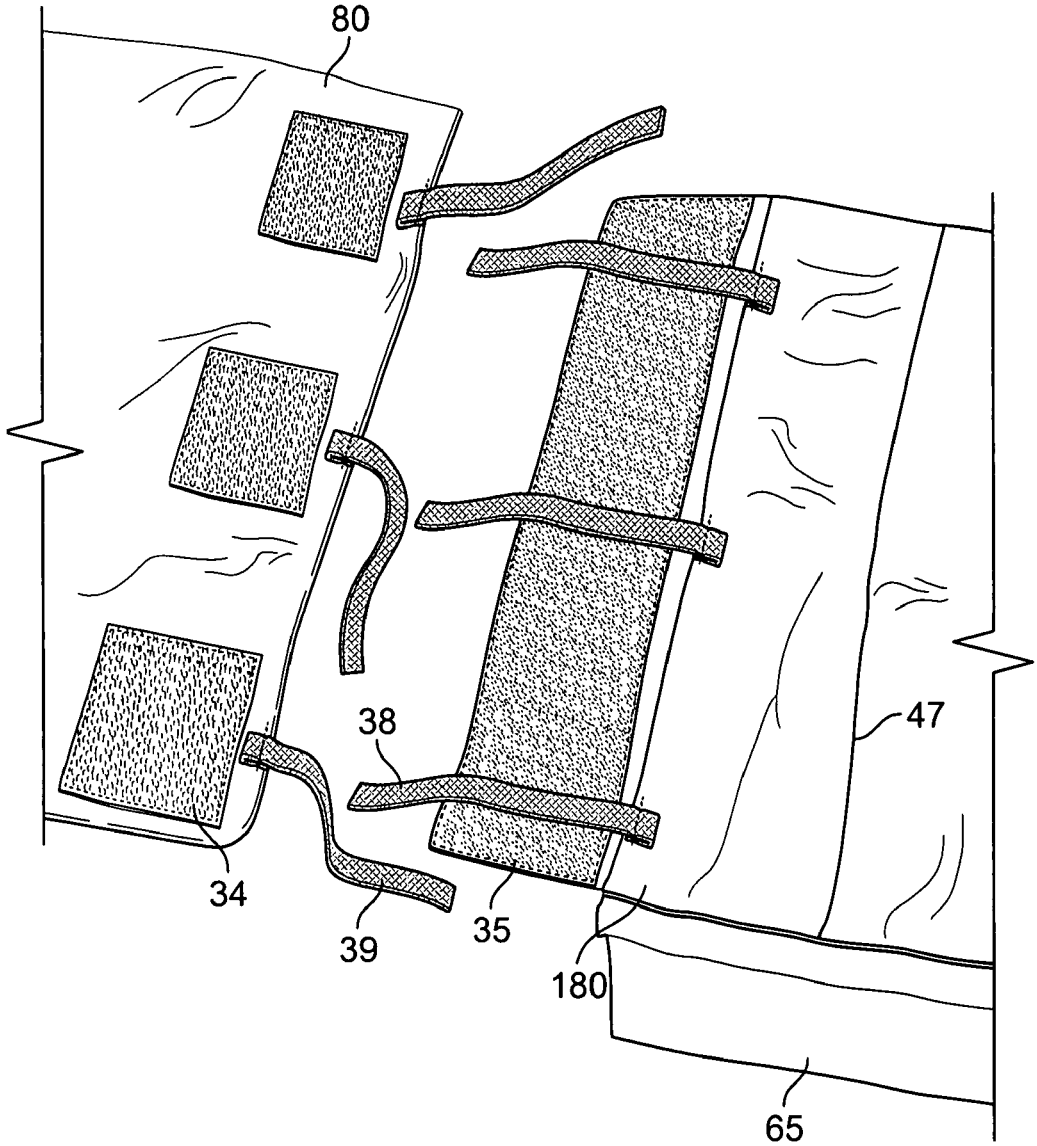
FIG. 7 is a perspective view of a main section facing up showing three squares of hook tape and a first extension section facing down showing a strip of loop tape.

FIG. 7 shows the underside of a first extension section 180 next to the top side of a main section 80. The middle of the trampoline is toward the bottom of the figure. The underside of the first extension section 180 is shown to provide a view of the pocket opening 47 which allows a strip of foam plastic cushion to be inserted into the trampoline pad. The foam plastic cushion typically provides a bulk of the cushioning in the trampoline pad. For the main trampoline pad section 80, a plurality of pocket openings 47 can be interspersed along the length of the main trampoline pad section 80. According to FIG. 7, a user can attach the first extension section 182 the main section 80 by flipping over the first extension section 180 and then pressing the loop strip portion 35 against the squares of hook portions 34. After using hook and loop connection, a user can alternatively and optionally use the straps 38, 39 for connecting both together for additional strength. The loop strip portion 35 may be formed as a flap not having foam plastic cushion disposed within. The empty flap provides more flexibility when connecting, but less padding.

A large sized configuration, a medium-size configuration and a small sized configuration can further be user configured in size if these sections are made according to the multiple flap system described above. For example, the first extension section 180 may instead of being constructed of a single flap be constructed to have an outer flap 150, and inner flap 170, and a main middle flap 160 according to FIGS. 3, and 4. Also, the second extension section 180 may have an outer flap 150, and inner flap 170 and a main middle flap 160. Furthermore, the main section 80 may also have the other flap, inner flap and main middle flap. By varying the number of arc sections and the configuration of flaps, a variety of configurations can be constructed. Three arc sections with three flaps provides three flap configurations and three arc configurations for a total of nine different possible combinations of those configurations.

Various trampoline pads can be constructed using the above configurations and combinations of the configurations. Trampoline pad sections should have an exterior cover covering a plastic foam core. A variety of pocket openings 47 allow for easy insertion of strips of plastic foam core. The pocket openings are preferably radial as shown in the figures.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. a second extension pad section movably connected to the main trampoline pad section and removably connected to the first extension pad section, wherein the second extension pad section has an arc shape roughly following the curvature of the main trampoline pad section f. a main trampoline pad inside flap connected to the main trampoline pad section, wherein the main trampoline pad inside flap is attached at an inside periphery of the main trampoline pad section; strap connectors connecting a first extension pad section end to a first main trampoline pad section end, and connecting a second extension pad section end to a second main trampoline pad section end; and a first pocket opening disposed in the first extension pad section, and a main pocket opening disposed in the main trampoline pad section, wherein the first pocket opening and the main pocket opening allows insertion of plastic foam cushion material.

2. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. a second extension pad section movably connected to the main trampoline pad section and removably connected to the first extension pad section, wherein the second extension pad section has an arc shape roughly following the curvature of the main trampoline pad section;

f. a second extension pad outside flap connected to the second extension pad section, wherein the second extension pad outside flap is attached at an outside periphery of the second extension pad section; and a first extension pad inside flap connected to the first extension pad section, wherein the first extension pad inside flap is attached at an inside periphery of the first extension pad section.

3. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

a first extension pad inside flap connected to the first extension pad section, wherein the first extension pad inside flap is attached at an inside periphery of the first extension pad section.

4. The adjustable trampoline pad system of claim 3, further comprising: a second extension pad outside flap connected to the second extension pad section, wherein the second extension pad outside flap is attached at an outside periphery of the second extension pad section.

5. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. a first extension pad inside flap connected to the first extension pad section, wherein the first extension pad inside flap is attached at an inside periphery of the first extension pad section; and a hook and loop connectors connecting a first extension pad section end to a first main trampoline pad section end, and connecting a second extension pad section end to a second main trampoline pad section end, wherein at least one of the hook and loop connectors is disposed on the underside of the extension pad section.

6. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. a main trampoline pad inside flap connected to the main trampoline pad section, wherein the main trampoline pad inside flap is attached at an inside periphery of the main trampoline pad section; and strap connectors connecting a first extension pad section end to a first main trampoline pad section end, and connecting a second extension pad section end to a second main trampoline pad section end, wherein at least one of the strap connectors is disposed on the underside of the extension pad section.

7. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. a main trampoline pad inside flap connected to the main trampoline pad section, wherein the main trampoline pad inside flap is attached at an inside periphery of the main trampoline pad section.

8. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. strap connectors connecting a first extension pad section end to a first main trampoline pad section end, and connecting a second extension pad section end to a second main trampoline pad section end, wherein at least one of the strap connectors is disposed on the main pad section f. a main trampoline pad inside flap connected to the main trampoline pad section, wherein the main trampoline pad inside flap is attached at an inside periphery of the main trampoline pad section.

9. An adjustable trampoline pad system comprising:

a. a main trampoline pad section having a plastic foam core enveloped inside an exterior cover, wherein the main trampoline pad section has an arc shape roughly following the circumference of a trampoline frame;

b. a main trampoline pad outside flap connected to the main trampoline pad section at an external periphery of the main trampoline pad section;

c. a first extension pad section removably connected to the main trampoline pad section, wherein the first extension pad section has an arc shape roughly following the curvature of the main trampoline pad section;

d. a first extension pad outside flap connected to the first extension pad section at an external periphery of the first extension pad section;

e. strap connectors connecting a first extension pad section end to a first main trampoline pad section end, and connecting a second extension pad section end to a second main trampoline pad section end, wherein at least one of the strap connectors is disposed on the main pad section f. a first extension pad inside flap connected to the first extension pad section, wherein the first extension pad inside flap is attached at an inside periphery of the first extension pad section; and a second extension pad outside flap connected to the second extension pad section, wherein the second extension pad outside flap is attached at an outside periphery of the second extension pad section.

10. The adjustable trampoline pad system of claim 9, further comprising: a hook and loop connectors connecting a first extension pad section end to a first main trampoline pad section end, and connecting a second extension pad section end to a second main trampoline pad section end.

* * * * *